United States Patent [19]

Young

[11] Patent Number: 4,553,122

[45] Date of Patent: Nov. 12, 1985

[54] CORED MAGNET WITH LIGHTWEIGHT LARGE AREA POLE PIECES

[75] Inventor: Ian R. Young, Sunbury-on-Thames, England

[73] Assignee: Picker International Limited, Middlesex, England

[21] Appl. No.: 578,510

[22] Filed: Feb. 9, 1984

[30] Foreign Application Priority Data

Feb. 25, 1983 [GB] United Kingdom ..... 8305303

[51] Int. Cl.[4] ..... H01F 7/20

[52] U.S. Cl. ..... 335/296; 335/297; 324/318

[58] Field of Search ..... 335/296, 297, 302, 303, 335/306; 324/318, 319

[56] References Cited

U.S. PATENT DOCUMENTS 1,132,016 3/1915 Jobke ..... 335/296

2,887,454 5/1959 Toulmin ..... 335/297 X 4,359,706 11/1982 Flack ..... 335/281

FOREIGN PATENT DOCUMENTS 1807941 3/1970 Fed. Rep. of Germany ..... 335/281

923537 7/1961 France ..... 335/302

*Primary Examiner*—George Harris

*Attorney, Agent, or Firm*—Watts, Hoffmann, Fisher & Heinke Co.

[57] ABSTRACT

A magnet pole piece for an NMR imaging magnet is made of a plurality of magnetic wires (3) with one end of each wire held in a non-magnetic spacer (1), the other ends of the wires being brought to a pinch (5), and connected to a magnetic core (6). The wires are embedded in a synthetic resin (4) and the magnetization and uniformity thereof can be varied by adjusting the density of the wires at the spacer which forms the pole piece.

14 Claims, 5 Drawing Figures

CORED MAGNET WITH LIGHTWEIGHT LARGE AREA POLE PIECES

Figure 1:
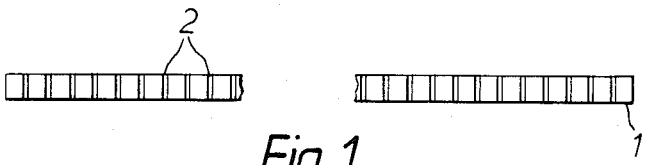

The present invention relates to magnets of the kind employing opposed pole pieces for establishing a magnetic field between them, and more especially, though not exclusively, to imaging magnets suitable for use in Nuclear Magnetic Resonance (N.M.R.) Imaging Systems.

If such a magnet has an iron core, this provides a decrease in the magnitude of the fringing magnetic field thus helping to overcome some of the difficulties in imaging associated with the fringing field, and allows for a more efficient design of the magnet.

It is still necessary, however, to achieve uniform flux between the pole pieces through the desired volume, and it is desirable that this be done in such a way as to keep the amount of iron in the system to a minimum so as to keep the weight as low as possible.

In accordance with the invention a magnet comprises a magnetic core extending between opposed pole pieces, at least one of which pole pieces comprises a plurality of wires of magnetic material, corresponding ends of which are spaced from each other by spacing means such that their end surfaces form an array which faces the opposite pole pieces, the parts of the wires which are adjacent the core being held relatively close to each other.

Preferably the spacing means is made of non-magnetic material.

Preferably also the spacing means comprises a rigid plate having holes therein, each wire having its end within a respective hole in the plate, and being secured therein in any convenient manner, the holes preferably being such that the sides of the holes support the parts of the wires within them substantially normal to the face of the plate facing the opposite pole piece.

Between the spacing means and the core, the wires are preferably embedded in a synthetic resin, for example an epoxy resin. The plate is conveniently flat, and the spaced ends of the wires are preferably flush with the surface of the plate facing the other pole piece. The parts of the wires which are adjacent the core are conveniently brought into close contact for example by being bound together.

Preferably also both pole pieces are constructed in a similar manner.

In order to produce or vary the magnetic field between the pole pieces a drive coil is conveniently disposed around the core in the vicinity of each pole piece.

Figure 2:
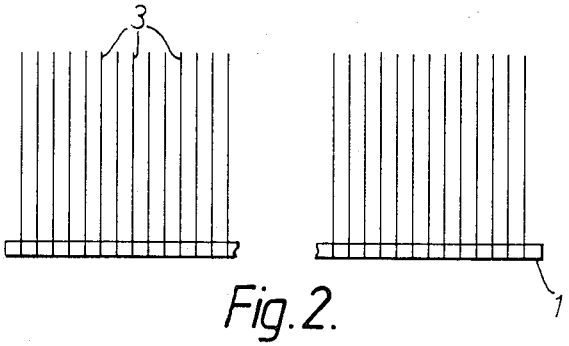
Figure 3:
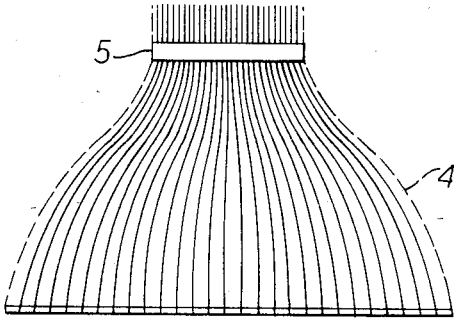
Figure 4:
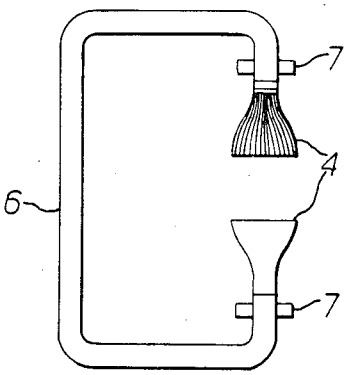
Figure 5:
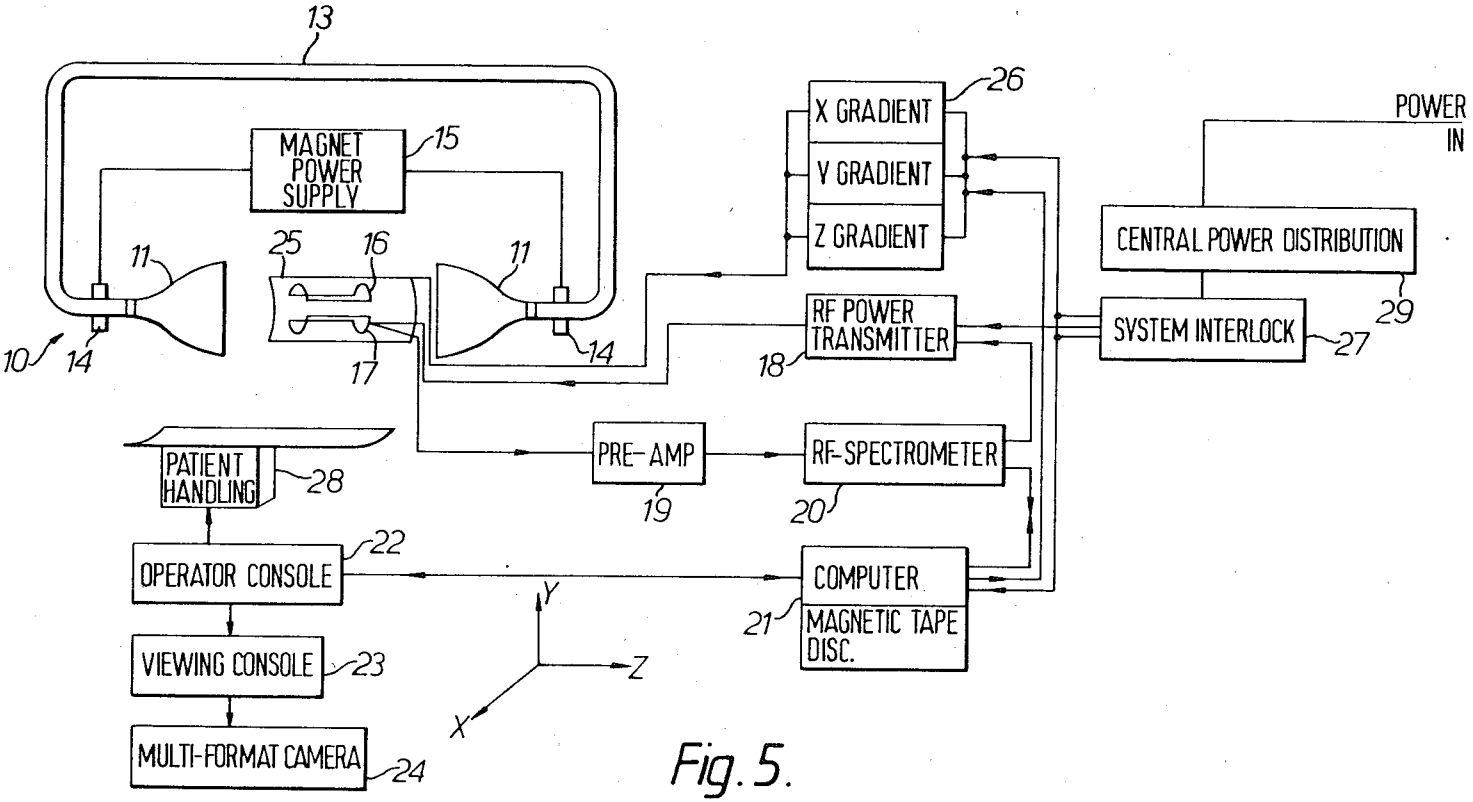

An embodiment of the invention will now be described with reference to the drawing in which:

FIGS. 1–3 show stages in the construction of a pole piece according to the invention, FIG. 4 is a schematic diagram of a magnet including at least one pole piece as shown in FIG. 3, and FIG. 5 is a schematic diagram of an NMR Imaging System employing a magnet according to the invention.

In FIG. 1 there is shown, in cross section, a flat member 1 of non-magnetic material in which holes 2 have been drilled. One end of each of a plurality of iron wires 3 is then inserted into a respective hole in the member, as shown in FIG. 2, and the other ends of the wires are brought to a pinch and clamped together as at 5 in FIG. 3, the complete pole piece structure then being potted in a resin such as epoxy as indicated at 4 which serves to secure the wires in the holes. The flat member 1 is of a thickness sufficient to ensure that the wires 3 are held substantially normal to the face of the member 1 when their ends are inserted in the holes 2.

As shown in FIG. 4, the pinched end 5 of the pole piece is then connected to a core 6 of magnet material and coils 7 are provided around the core next to the pole piece to produce the field.

The ends of the wires within the flat member thus provide a pole face larger than the cross section of the core with a substantial reduction in the weight of the pole piece.

If a constant magnetisation per unit area is required, then the density of holes in the member is made uniform, but the magnetisation may be varied by adjusting the density of holes. Also, the hole density needs to be large enough to avoid high order ripples appearing in the field, and to achieve the desired magnetisation without magnetic saturation of the wires.

The core 6 may be formed of a solid member of magnetic material or may be constituted by a continuation of the wires forming the pole pieces.

Such a magnet is especially useful in NMR Imaging Systems of the type used in examination of patients for medical purposes, such as described in U.K. Patent Specifications Nos. 1,578,910 and 2,056,078, for example.

The apparatus basically includes a first magnet system whereby a static magnetic field can be applied to a body to be examined in a given direction, normally designated the Z-direction, with a gradient in any one or more of the three orthogonal directions i.e. X, Y, and Z directions.

Referring to FIG. 5, the first magnet system 10 comprises a pair of pole pieces 11 of the type described above in accordance with the invention, the ends of which, are connected together by means of a core 13, and coils 14 are provided around the core next to the pole pieces and are connected to a power supply 15 for producing the magnetic field between the pole pieces. R.F. coils 16 and 17 are each connected to an R.F. power transmitter 18 and are used to excite and pick up NMR signals in a patient (not shown) lying in the Z-direction within the magnet system 10 on a patient handling device 28.

The NMR output signals are amplified in a preamplifier 19, analysed in an R.F. spectrometer 20 and processed in a computer 21 under the control of an operator console 22, which is in turn linked to a viewing console 23 and multi-format camera 24. Three sets of magnetic field gradient coils, only one of which is shown at 25, generate controlled nominally linear magnetic field gradients in the X, Y and Z directions in response to a field controller 26. The overall operation of the apparatus is controlled by a system interlock 27 powered by a central power distribution system 29.

The use of a magnet according to the invention instead of conventional magnets results in a substantial reduction in iron and therefore in weight of the system.

The NMR Imaging system as shown in FIG. 5 and described above is particularly useful for scanning small parts of a patient but may, if required, be made large enough for scanning larger parts.

I claim:

1. A magnet comprising a magnetic core extending between opposed pole pieces, at least one of which pole pieces comprises a plurality of wires of magnetic material, corresponding ends of which are spaced from each other by spacing means such that their end surfaces form a planar array which faces the opposite pole piece, the density of the end surfaces per unit area being sufficiently great for the field within the space between the pole pieces to be substantially free of variations corresponding to the positions of said end surfaces, the parts of the wires which are adjacent the core being held in close contact with each other and with the core.

2. A magnet according to claim 1 wherein the spacing means is made of non-magnetic material.

3. A magnet according to claim 1 wherein the spacing means comprises a rigid plate having holes therein, each wire having its end within a respective hole in the plate.

4. A magnet according to claim 3 wherein the sides of the holes support the parts of the wires within the holes substantially normal to the face of the plate facing the opposite pole piece.

5. A magnet according to claim 3 wherein the plate is flat.

6. A magnet according to claim 3 wherein the spaced ends of the wires are flush with the surface of the plate facing the other pole piece.

7. A magnet according to claim 1 wherein said parts of the wires which are in close contact with each other are bound together.

8. A magnet according to claim 1 wherein between the spacing means and the core the wires are embedded in a synthetic resin.

9. A magnet according to claim 8 wherein the resin is an epoxy resin.

10. A magnet according to claim 1 wherein both pole pieces are constructed in a similar manner.

11. A magnet according to claim 1 further comprising a drive coil disposed around the core in the vicinity of each pole piece.

12. An N.M.R. Imaging system of the kind employing a magnet system for applying a magnetic field to a body to be examined, wherein the magnet system comprises a magnet according to claim 1.

13. A magnet comprising a magnetic core extending between opposed pole pieces, at least one of which pole pieces comprises a plurality of wires of magnetic material, corresponding ends of which are spaced from each other by spacing means such that their end surfaces form a planar array which faces the opposite pole piece, the density of the end surfaces per unit area being sufficiently great for the field within the space between the pole pieces to be substantially uniform, the parts of the wires which are adjacent the core being held in close contact with each other and with the core.

14. A nuclear magnetic resonance imaging system of the kind employing a magnet system for applying a magnetic field to a body to be examined and including a static uniform field component wherein the magnet system includes, for applying said component, a magnet comprising a magnetic core extending between opposed pole pieces, at least one of which pole pieces comprises a plurality of wires of magnetic material, corresponding ends of which are spaced from each other by spacing means such that their end surfaces form a planar array which faces the opposite pole piece, the density of the end surfaces per unit area being sufficiently great for the field within the space between the pole pieces to be substantially free of variations corresponding to the positions of said end surfaces the parts of the wires which are adjacent the core being held in close contact with each other and with the core.

* * * * *